US006550651B1

(12) United States Patent
Murdoch et al.

(10) Patent No.: US 6,550,651 B1
(45) Date of Patent: Apr. 22, 2003

(54) BACKPACK

(75) Inventors: Douglas H. Murdoch; Michael Sturm, both of Santa Rosa, CA (US)

(73) Assignee: Daymen Photo Marketing, Ltd., Markham (CA)

( * ) Notice: Subject to any disclaimer, the term of this patent is extended or adjusted under 35 U.S.C. 154(b) by 0 days.

(21) Appl. No.: 09/516,044

(22) Filed: Mar. 1, 2000

(51) Int. Cl.[7] ..... A45F 4/02; A45F 3/04

(52) U.S. Cl. ..... 224/153; 224/580; 224/627; 224/637; 224/645; 190/18 A

(58) Field of Search ..... 224/153, 579, 224/580, 578, 627, 628, 637, 645, 651; 190/18 A

(56) References Cited

U.S. PATENT DOCUMENTS

| | | | | | |
|---|---|---|---|---|---|
| 922,046 | A | | 5/1909 | Royce | |
| 2,401,986 | A | | 6/1946 | Talbott | |
| 2,581,417 | A | * | 1/1952 | Jones | 190/18 A |
| 3,233,803 | A | | 2/1966 | Gray | |
| 3,550,997 | A | | 12/1970 | Strand | |
| 4,254,850 | A | * | 3/1981 | Knowles | 190/18 A |
| 4,354,583 | A | * | 10/1982 | Walker | 190/18 A |
| 4,375,828 | A | * | 3/1983 | Biddison | 224/153 X |
| 5,022,574 | A | | 6/1991 | Cesari | |
| 5,054,589 | A | * | 10/1991 | Bomes et al. | 190/18 A |
| 5,209,384 | A | * | 5/1993 | Anderson | 224/657 X |
| 5,407,039 | A | * | 4/1995 | Alper et al. | 190/18 A |
| 5,460,307 | A | * | 10/1995 | Stevenson | 224/153 |
| 5,588,569 | A | | 12/1996 | Mitomi et al. | |
| 5,634,576 | A | | 6/1997 | Arbel | |
| 5,676,286 | A | | 10/1997 | Song | |
| 5,680,973 | A | * | 10/1997 | Vulpitta et al. | 224/153 |
| 5,685,402 | A | * | 11/1997 | Lin | 190/18 A |
| 5,743,447 | A | | 4/1998 | McDermott | |
| 5,749,503 | A | | 5/1998 | Wulf et al. | |
| 5,779,121 | A | * | 7/1998 | Capwell | 224/153 X |
| 5,826,771 | A | * | 10/1998 | Peng | 224/651 |
| 5,984,154 | A | * | 11/1999 | Scicluna | 224/579 X |
| 6,024,265 | A | * | 2/2000 | Clements | 224/645 X |
| 6,076,641 | A | * | 6/2000 | Kinzer et al. | 190/18 A |
| 6,098,768 | A | * | 8/2000 | Tsai | 190/18 A |
| 6,116,701 | A | * | 9/2000 | Kuo | 190/18 A |

FOREIGN PATENT DOCUMENTS

| | | | | |
|---|---|---|---|---|
| GB | 1099200 | * | 1/1968 | 190/18 A |

* cited by examiner

*Primary Examiner*—Stephen K. Cronin
(74) *Attorney, Agent, or Firm*—R. Dabney Eastman

(57) ABSTRACT

A backpack (10) suitable for use with wheels (200) at its base adjacent to a non body-contact side (40) has a U-shaped opening (22) proximate to a body-contact side (30) that is closed with a zipper (31). The body-contact side (30) is provided with two shoulder straps (34) and a hip belt (36). Side straps (130) and a top flap or strap (134) connect the body-contact side (30) to other parts of the backpack (10), such as the non body-contact side (40), to take a substantial part of the weight of the backpack (10) and its contents so that the zipper (31) is not stressed or tensioned when the backpack (10) is worn on the back of a user. The wheels (200) are removable and can be larger than is usual for use on rough ground. A frame (100) with a built-in extending handle system (120) is mounted inside and ajacent to the non body-contact side (40).

19 Claims, 10 Drawing Sheets

FIG. 13
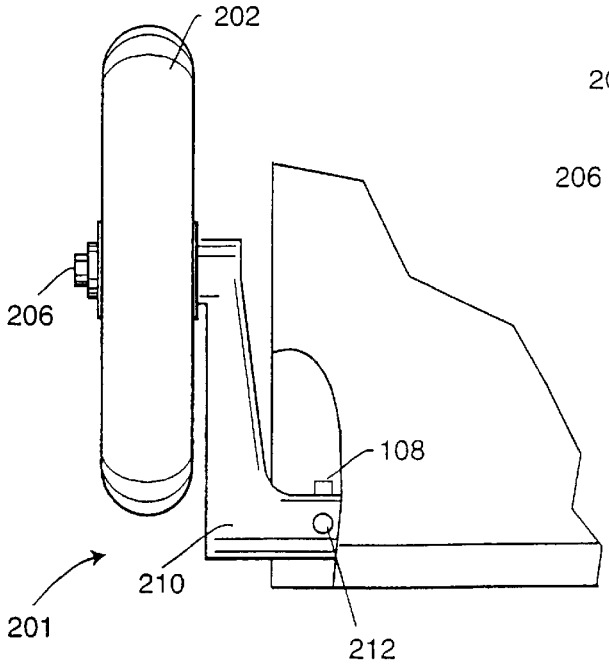
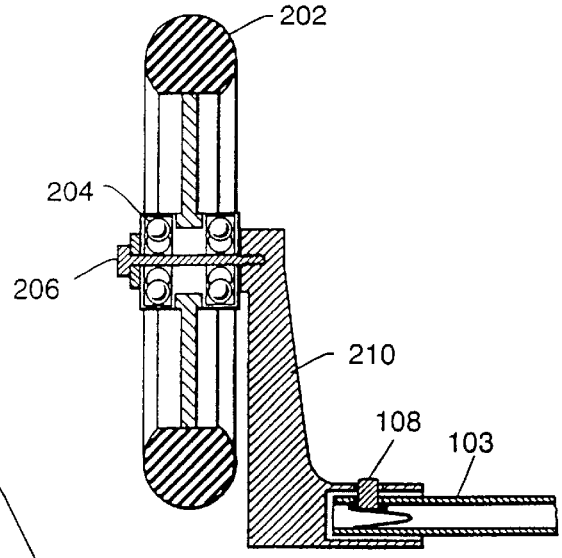
FIG. 14
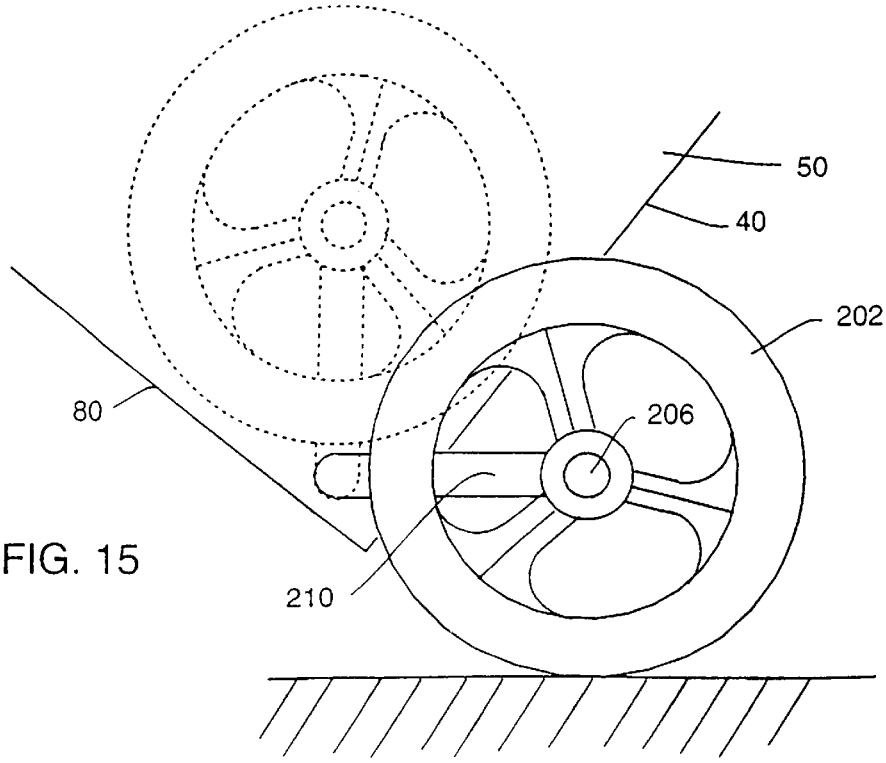
FIG. 15

BACKPACK

FIELD OF THE INVENTION

The invention relates to a backpack or a knapsack.

BACKGROUND OF THE INVENTION

Backpacks or knapsacks are containers, usually made of fabric, that have straps and other means for permitting a user to carry the container on his or her back. A backpack has a pair of shoulder straps, and perhaps a hip belt (together, the shoulder straps and the hip belt are known as the "harness") on its body-contact side for attachment to the user's shoulders and hips, respectively, to support and secure the backpack in place against the user's back. The use of a tumpline secured to the user's forehead in place of shoulder straps and hip belt is of course well known, particularly in the Kingdom of Nepal, but the discussion of backpacks in this section of the specification will assume that shoulder straps and perhaps a hip belt are provided.

A user that carries heavy loads in a backpack attached to his or her back will expend considerable energy even when traveling over level terrain, in addition to suffering aches and pains. One way to reduce the exertion and pain of carrying heavy loads, of course, is to reduce the weight of the load carried. Reducing the weight carried is often more easily advocated than accomplished. The "Ray way" advocated in recent years by ultra long distance hiker Ray Jardine is a disciplined approach to the reduction of pack weight evolved in the context of long distance backpacking, such as for through-hikes of the Pacific Crest Trail. See generally Ray Jardine, *The Pacific Crest Trail Hiker's Handbook* (1996).

Nevertheless, a reduction in the load to be carried is not always possible. For example, professional photographers may have to carry a minimum amount of photographic equipment, in addition to personal gear, in order to perform an assignment. The necessary lenses, camera bodies, tripods, and the like will often amount to a considerable weight.

Climbers often must carry heavy technical climbing gear in addition to their survival gear and rations. In addition, big wall climbers must carry large (and thus heavy) quantities of water to the base of their climbs.

The adults in families with small children may need to carry a considerable amount of gear for both themselves and the children when traveling or hiking.

Hikers and other travelers may be unwilling to make the sacrifices in creature comforts needed to travel with a light load. Furthermore, persons planning to hike long distances without resupply will need to carry a large amount of food. A large and heavy quantity of water will be carried if crossing terrain lacking water sources, such as in deserts.

Thus, one solution to reducing the exertion and pain of carrying a heavy load is to provide a container for the load with wheels so that the container can be pushed or pulled across the surface of the ground (by surface of the "ground" is meant any natural or man-made surface) while the wheels support the weight of the container. This mode of transporting a container will require less exertion (and pain) because the user does not have to support the dead weight of the backpack and its contents.

Of course, the user can employ this mode of transport only when the nature of the ground permits. Rough and irregular surfaces could make supporting and rolling a container on its wheels inconvenient because the irregularities will resist the movement of the wheels and the container will have to be lifted over these irregularities. Some surfaces may be so rough and steep that the user will have to employ his or her hands in order to progress up, down or laterally, such as in climbing at Class 3 (Yosemite Decimal System) and above, and will not be able to spare a hand to push or pull the container. Furthermore, the user may have to employ his or her hands to carry handbags or other containers and will not have a free hand to push or pull the wheeled container.

In such situations, the user must carry the container, preferably on his or her back. Providing wheels to a backpack therefore permits the user to choose the mode of transport according to the situation at hand.

Wheeled backpacks have been known for some time. For example, Talbot, U.S. Pat. No. 2,401,986, describes a "pack cart of a type adapted to be used as a cart for wheeling a pack over the ground or as a pack frame for carrying a pack on the back." Other examples of backpacks with wheels are H. R. Strand, U.S. Pat. No. 3,550,997 for a "Backpack Trundling Assembly," Cesari, U.S. Pat. No. 5,022,574 for a "Utility Bag," Mitomi, et al., U.S. Pat. No. 5,588,569 for a "Carrier Bag," Arbel, U.S. Pat. No. 5,634,576 for a "Knapsack," McDermott, U.S. Pat. No. 5,743,447 for a "Portable Variable Capacity Backpack," and Wulf, et al., U.S. Pat. No. 5,749,503 for a "Convertible Luggage System." Typically, such backpacks have at least two wheels, a handle at the top for pulling or pushing the backpack when it is rolling on the wheels, and some form of rigidity due to an external frame, internal stiffening members or a hard shell construction.

A useful development of late is shown in Wulf, et al., which has a rigid handle that can be deployed from the top of the backpack or luggage container but can also be stored internally in a retracted position.

The known wheeled backpacks have wheels that are "fixed," meaning that the wheels are not designed to be removed by the user. Furthermore, these wheels are usually placed at the bottom of the body-contact side of the backpack, as in Wulf, et al., Arbel, Mitomi, et al., and McDermott. This has the disadvantage of placing of placing the wheels adjacent to the user's back when the backpack is carried on the user's back. For this reason, Wulf, et al. provide a cover to be wrapped over the wheels to protect the user's back from the "filth that accumulates on the wheels." Another disadvantage is that the harness (shoulder straps and possibly a hip belt) is exposed to or dragged on the ground when the backpack is pulled or pushed in its wheel-supported or rolling mode. Wulf, et al. therefore secure the cover previously mentioned over the shoulder straps when the backpack or luggage container is in the rolling mode.

Strand and Talbott address these problems by providing wheels on complicated swiveling frames that deploy the wheels into a rolling or ground-contacting position below the backpack or in front of the body-contact side, respectively. The swiveling frames position the wheels adjacent the non body-contact side when the backpack is to be carried on the user's back. Tetzlaff, German Patentschrift 120005, locates the wheels at the top of the non body-contact side.

Another solution to the problems noted above is to place the wheels at the base of the non body-contact side of the backpack, as in Song, U.S. Pat. No. 5,676,286 for a "Wheeled Knapsack." The wheels therefore are never adjacent to the user's back when the user carries Song's wheeled knapsack or backpack on his or her back. No complicated and heavy swiveling frames for the wheels are needed. Furthermore, the harness or shoulder straps (and hip belt, if one is provided) is positioned away from the ground when the backpack is pulled across the surface of the ground on its wheels.

Song, however, does not explain how the "bag portion" or body of her knapsack is to be provided with the rigidity necessary for her wheeled knapsack to be pulled across the surface of the ground in a rolling or wheel-supported mode without deformation of the bag and contact of parts of the bag, other than the wheels, with the ground. Song also does not show how the user will access the compartment inside her wheeled knapsack.

Backpacks traditionally have openings at their tops (top-loaders such as the Great Pacific Iron Works' Creagh Dubh climbing pack and The North Face's Liberty backpack) or on the non body-contacting side (panel loaders such as The North Face's Ruthsac backpack and Big Shot backpack) or a hybrid or combination of the two (such as Lowe Alpine Systems' Contour IV backpack) to provide access to the contents of the main or interior compartment or compartments of the backpack. See generally Kristin Hostetter, Packs, Backpacker Magazine 2000 Gear Guide, March 2000, at 14. Such backpacks must be placed on their bottoms or on their body-contacting sides in order for the user to access the contents of the main or interior compartment(s) of the backpacks. A panel-loading backpack provides excellent access to the interior compartment(s) of the backpack but at the requirement of placing the pack on its body-contacting side. This will require putting the harness on the ground or other surface and thereby exposing it to dirt and abrasion.

Song's backpack will have the body-contacting side upwards when the backpack is supported on its wheels. This position will render access to the inner compartment difficult if her backpack is a panel-loader of the known kind unless the Song backpack is tipped onto its body-contacting side, which will have the negative effects mentioned above.

Furthermore, Song provides only a flexible U-shaped handle or a strap to be grabbed and pulled by the user when her wheeled knapsack is in its rolling mode. A flexible handle does not provide sufficient control of a wheeled backpack in its rolling mode and cannot be used to push the backpack when in that mode. Song also teaches the use of "fixed" wheels, which means that the size of the wheels must be small enough to not be in the way or inconvenient when her wheeled knapsack is carried on the back or otherwise not in its rolling mode of use. Smaller wheels, however, are difficult to use on irregular surfaces.

A need exists, therefore, for a backpack that can be equipped with wheels at its base adjacent its non body-contact side for transport in a rolling mode on the surface of the ground and has the necessary structural rigidity, an opening into its inner compartment that will not require the harness to be placed on the ground when the user accesses the inner compartment, a handle for pushing as well as pulling, and wheels suitable for use on rough ground.

SUMMARY OF THE INVENTION

The invention provides a backpack with features especially useful for a backpack equipped with wheels.

A preferred embodiment of a backpack according to the invention comprises a bag portion having a body-contact side, a non-body contact side, two side panels, a top, and a base, the body-contact side and the non body-contact side facing each other and being joined to the base, the side panels, and the top so as to define a compartment; a pair of shoulder straps provided on the body-contact side of the bag portion and adapted to be hung from the user's shoulders; a U-shaped opening defined in the bag portion adjacent and parallel to the body-contact side; a zipper having complementary halves attached on either side of the opening, the haves of the zipper having at least one slider for reversibly separating the halves of the zipper for permitting access to the compartment and reversibly attaching the halves of the zipper for securing the opening from entry from the exterior of the backpack; a frame assembly extending along and attached to the non body-contact side, the frame assembly comprising a bottom portion and a top portion; at least one wheel assembly attached to the bottom portion of the frame assembly, at least a portion of the wheel assembly extending out from the bag portion whereby the wheel assembly can support a substantial part of the weight of the backpack when the bag portion is substantially above the wheel assembly and the wheel assembly is in contact with a surface; and a handle attached to a first end of at least one member made of a rigid material and mounted to the frame so that the member can slide between an extended position above the top portion of the frame assembly in which the user can grasp the handle and pull or push the bag portion of the backpack across a surface when the weight of the bag portion is substantially resting on the at least one wheel assembly and a retracted position in which the handle is adjacent the top portion of the frame assembly.

Another preferred embodiment of the backpack according to the invention comprises a bag portion having a body-contact side, a non-body contact side, two side panels, a top, and a base, the body-contact side and the non body-contact side facing each other and being joined to the base, the side panels, and the top so as to define a compartment; a pair of shoulder straps provided on the body-contact side of the bag portion and adapted to be hung from the user's shoulders; a U-shaped opening defined in the bag portion adjacent and parallel to the body-contact side; a zipper having complementary halves attached on either side of the opening, the haves of the zipper having at least one slider for reversibly separating the halves of the zipper for permitting access to the compartment and reversibly attaching the halves of the zipper for securing the opening from entry from the exterior of the backpack; and at least one side strap joining the body-contact side to one of the side panels and the non body-contact side whereby a substantial part of the weight of the backpack is transferred to the body-contact side when the backpack is mounted on the user's back and thereby reducing the tension on the zipper when the opening to the compartment is closed.

This preferred embodiment of a backpack according to the invention may further comprise a top strap disposed across the top, the top strap comprising a first end attached to the body contact side, a second end attached to one of the top and the non body-contact side, and intermediate releasable fastening means whereby the top strap can be connected across and above the opening in order to reduce the tension on the zipper when the opening to the compartment is closed and the backpack is mounted on the user's back.

Yet another preferred embodiment of a backpack according to the invention comprises a body portion defining a compartment, the body portion comprising a body-contact side, the body-contact side comprising at least one stiffening member and a pair of shoulder straps provided on the body-contact side adapted to be hung from the user's shoulders; a U-shaped opening defined in the bag portion adjacent and parallel to the body-contact side; a zipper having two ends and complementary halves attached on either side of the opening, the haves of the zipper having at least one slider for reversibly separating the halves of the zipper between the two ends for permitting access to the compartment and reversibly attaching the halves of the zipper for securing the opening from entry from the exterior of the body portion; and the opening curves at either end of the zipper so that the ends of the zipper are substantially in line and directed toward each other, whereby the zipper is not twisted when the body-contact side is rotated away from the remainder of the body portion in order to expose the compartment to access from the exterior.

A further preferred embodiment of a pack according to the invention comprises a bag portion having front and back sides and a base, the front and back sides facing each other and being joined to the base; a frame assembly attached to the bag portion and having an upper end and a lower end, the lower end being adjacent to the base of the bag portion; two wheel assemblies detachably connected to the lower end of the frame assembly, the two wheel assemblies when connected to the frame assembly being positioned apart from each other and having the same axis, the two wheel assemblies further being capable of being attached to and detached from the frame assembly by the user; and a handle attached to the frame assembly for pulling the backpack when the wheel assemblies support the backpack on the ground.

Still another preferred embodiment of a backpack according to the invention comprises a bag portion having a body-contact side, a non body-contact side, and a base, the body-contact side and the non body-contact side facing each other and being joined to the base; a frame attached to one of the body-contact side and the non body-contact side; a pair of shoulder straps provided on the body-contact side of the bag portion and adapted to be hung from the user's shoulders; two wheel assemblies connected to the frame and positioned apart from each other and having the same axis; and a handle attached to the bag portion for pulling the backpack on the ground, the handle having at least one extensible member slidably attached to the frame and grip portion for being grasped by the user's hand, the extensible member having an extended position away from the base so that the handle can be readily grasped by the user for towing or pushing the backpack and a contracted position adjacent the frame, the movement of the extensible member between the extended position and the contracted position being accomplished at least in part by the user exerting pressure on the grip portion away from the bag portion or towards the bag portion, repectively.

OBJECTS OF THE INVENTION

An object of the invention is to provide a backpack with an opening adjacent the body-contact side.

A further object of the invention is to provide a system for substantially reducing the tension on the zipper or other apparatus closing an opening adjacent the body-contact side of a backpack when the user carries the backpack on his or her back.

Still another object is to provide a backpack with wheel assemblies.

A related and further object is to provide a backpack with wheel assemblies that permit greater stability and cross-country mobility than known packs when in the rolling or wheel-supported mode of transport.

Another object of the invention is to provide a backpack with removable wheels at the base of the non body-contact side of the backpack.

Yet another object of the invention is to provide a backpack with wheels at the base of the non body-contact side of the backpack and an internal frame for stiffening.

A related and further object is to provide a backpack with wheels at the base of the non body-contact side of the backpack and a handle system that is rigid when deployed so that the backpack may be pushed with the handle system when it is supported by its wheels in a rolling mode.

A yet further object is to provide a backpack with wheels at the base of the non body-contact side of the backpack and an opening into an interior compartment adjacent the body-contact side of the backpack.

DESCRIPTION OF THE DRAWINGS

Other objects, features, and advantages of the present invention will become more fully apparent from the following detailed description of preferred embodiments, the appended claims, and the accompanying drawings in which:

FIG. 13 is a side elevational view of another preferred embodiment of a removable wheel assembly for use in a backpack according to the invention shown mounted on a portion of a frame assembly;

FIG. 14 is a sectional view of the wheel assembly of FIG. 13; and

FIG. 15 is a front elevational view of the wheel assembly of FIG. 13 showing the operational or "down" position and the retracted position.

REFERENCE NUMERALS IN THE DRAWINGS

Figure 1:
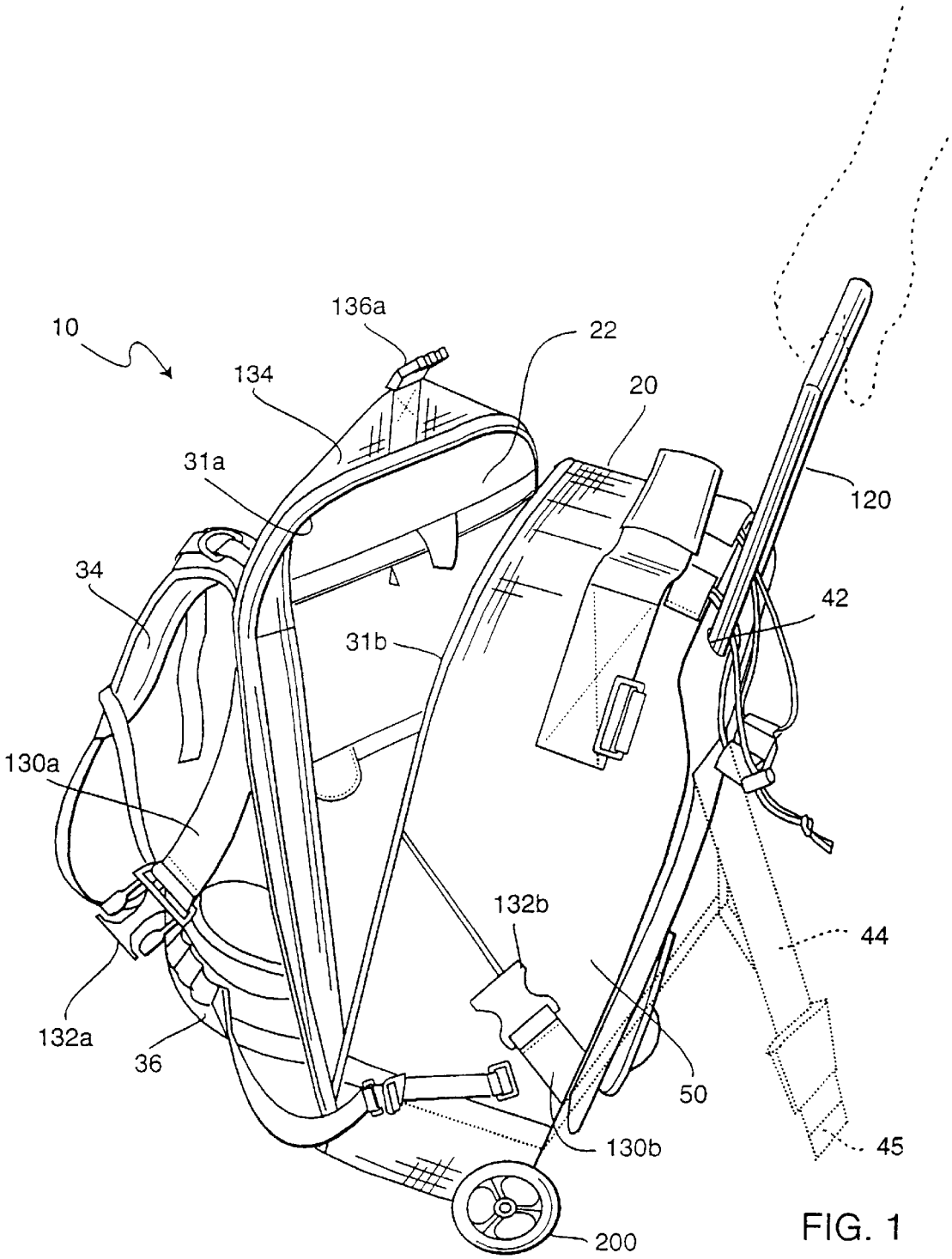
FIG. 1 is a right perspective view from above of a preferred embodiment of the backpack according to the invention.
Figure 2:
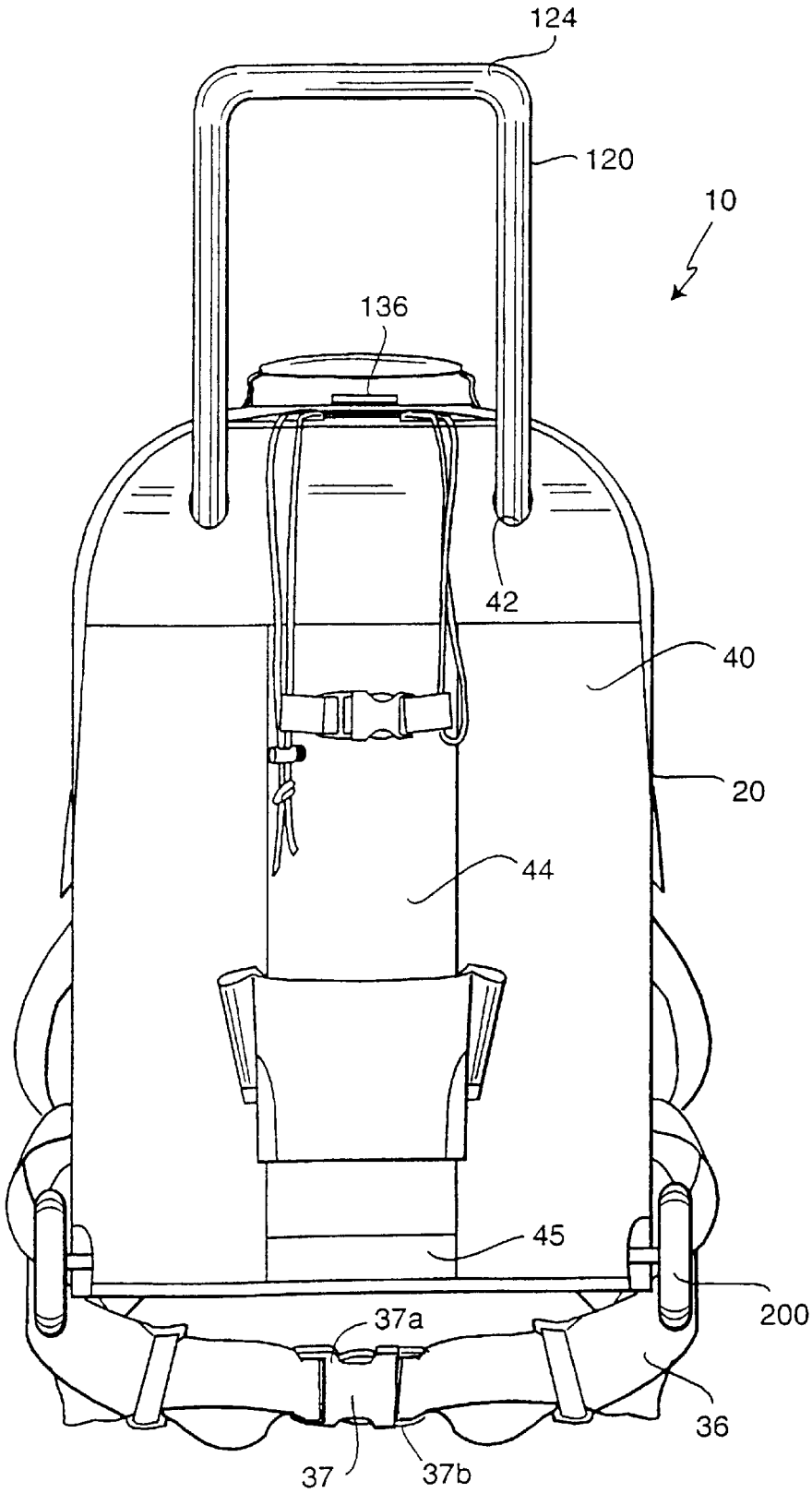
FIG. 2 is a front elevational view of the backpack of FIG. 1, showing the non body-contact side.

| | |
|---|---|
| 10 | Backpack |
| 20 | Bag portion |
| 21 | Inner compartment |
| 22 | Opening |
| 22a | Opening end |
| 30 | Body-contacting or back side |
| 30a | Body hinge portion |
| 30b | Top edge |
| 30c | Side edge |
| 30d | Side edge |
| 31 | Zipper |
| 31a | Zipper portion or complementary half |
| 31b | Zipper portion or complementary half |
| 31c | Zipper slider |
| 32 | Harness |
| 34 | Shoulder strap |
| 35 | Weather flap |
| 36 | Hip belt |
| 37 | Hip belt buckle |
| 37a | Hip belt buckle, female component |
| 37b | Hip belt buckle, male component |
| 38 | Stave |
| 39 | Back pad |
| 40 | Front or non body-contacting side |
| 42 | Aperture |
| 44 | Stand |
| 45 | Ground-contacting end |
| 50 | Left side panel |
| 60 | Right side panel |
| 70 | Top |
| 80 | Bottom |
| 81 | Bottom portion adjacent to zipper |
| 100 | Frame assembly |
| 101 | Vertical or top portion of frame assembly |
| 102 | Horizontal or bottom portion of frame assembly |
| 103 | Axle tube |
| 104 | Angle piece |
| 105 | Securing screw |
| 106 | Securing panel |
| 107 | Detent (for receiving spring-loaded pin 127) |
| 108 | Spring-loaded pin |
| 120 | Handle assembly |
| 122 | Vertical tube |
| 122a | Flat base extension |
| 124 | Handle tube |
| 125 | Spring-loaded pin |
| 126 | Aperture (for receiving spring-loaded pin 125) |
| 127 | Spring-loaded pin |
| 130 | Side strap |
| 130a | Side strap portion |
| 130b | Side strap portion |
| 132 | Side buckle |
| 132a | Side buckle, male component |
| 132b | Side buckle, female component |
| 134 | Top flap |
| 136 | Top buckle |
| 136a | Top buckle, male component |
| 136b | Top buckle, female component |
| 138 | Sleeve |
| 140 | Side force arrow (imaginary) |
| 142 | Top force arrow (imaginary) |
| 200 | Wheel assembly, first embodiment |
| 201 | Wheel assembly, second embodiment |
| 202 | Wheel portion |
| 204 | Bearing unit |
| 206 | Axle bolt |
| 208 | Axle sleeve |
| 210 | Axle leg |
| 212 | Aperture (for receiving spring-loaded pin 108) |

DETAILED DESCRIPTION OF THE PREFERRED EMBODIMENTS

A preferred embodiment 10 of the backpack according to the invention is shown in FIGS. 1–8. The backpack 10 has a bag portion 20 that has approximately the shape of a rectangular parallelepiped and defines an inner compartment 21 (best seen in the sectional view of FIG. 8) that is accessed through an opening 22 (see FIG. 1).

The bag portion 20 has six sides: a body-contacting or back side 30, a non body-contacting or front side 40, left and right side panels 50 and 60, respectively, a top 70, and a bottom 80. The backpack 10 is supported by wheel assemblies 200 attached to an internal frame assembly 100 at about the juncture of the bottom 80 and the non body-contacting side 40 (see, e.g., FIG. 4). The user pulls (or pushes) the backpack 10 by the handle assembly 120, as shown in FIG. 1. The handle assembly 120 is rigid when in the extended position shown in FIG. 1. This rigidity permits the user to push the backpack 10 using the handle system 120. The backpack 10 also may be carried on the user's back (not shown) by means of the harness 32 on the body-contacting side 30.

The bag portion 20 is preferably made of an exterior layer of tough fabric, such as 600-denier ballistic nylon fabric, and a lining of a lighter fabric, such as 210-denier nylon fabric. A layer of closed cell foam preferably is provided between the inner and outer layers to provide stiffening and to protect any equipment carried in the compartment 21 from shocks and vibration. The detailed structure of the bag portion 20's six sides just described is not shown in the drawings but may be manufactured by techniques well known in the art of backpacks and soft luggage. As will be discussed below, the bag portion 20 also incorporates a frame assembly 100 and a pair of staves 38 to provide vertical stiffening for the purpose of improving its performance in the rolling and backpack modes of transport.

Figure 3:
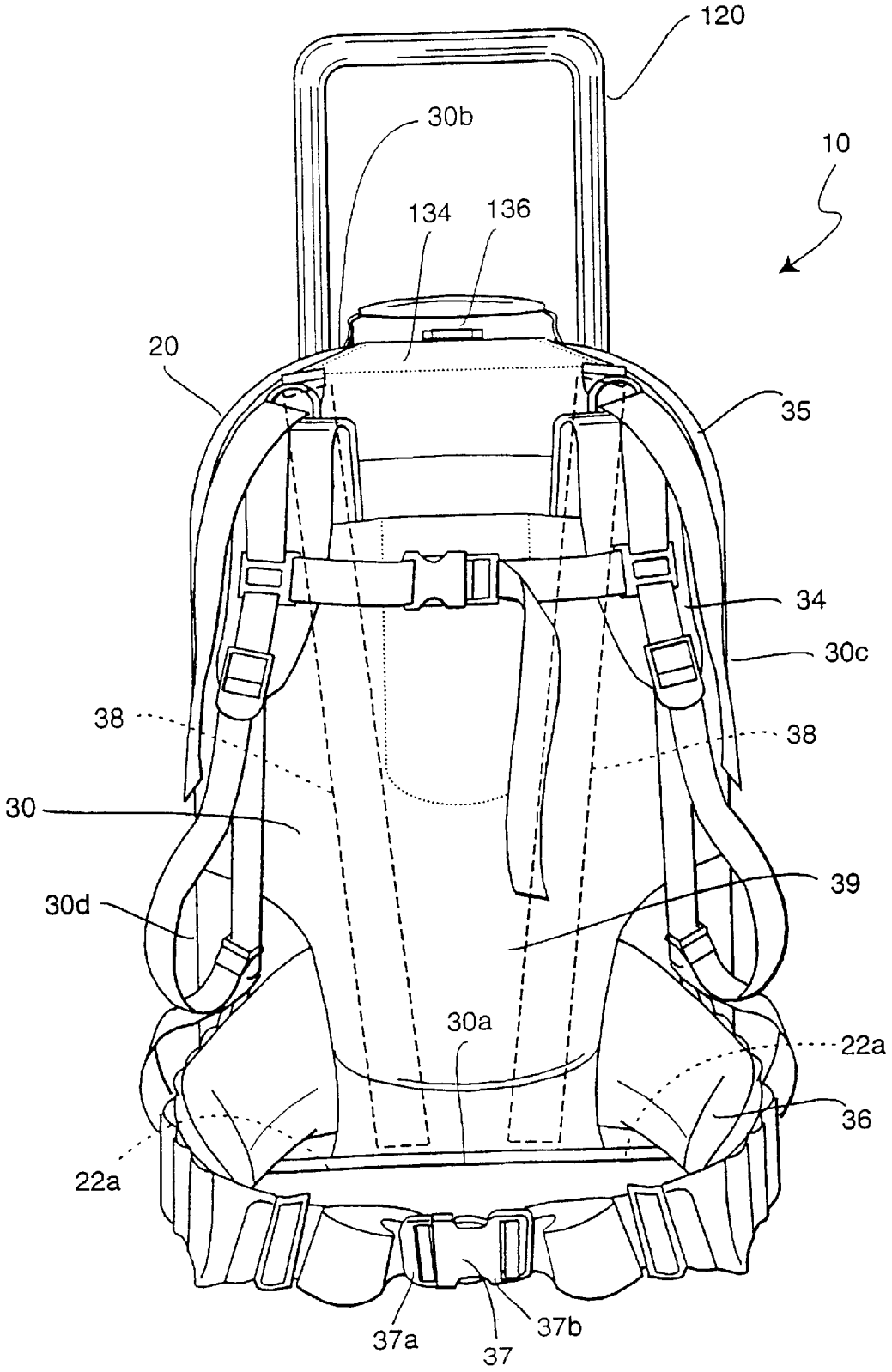
FIG. 3 is a back elevational view of the backpack of FIG. 1, showing the body-contact side.

The body-contacting side 30 is essentially a panel that is hinged to the remainder of the bag portion 20 by its bottom hinge portion 30*a* (see FIG. 3) and is divided from the remainder of the bag portion 20 by the opening 22 that is substantially U-shaped as seen from the body contacting side (see FIG. 3). The body-contacting side is therefore separable from the side panels 50 and 60 and from the top 70. In addition, the opening 22 extends along the portions 81 (see FIG. 3) of the juncture between the bottom 80 and the body-contacting side 30, so that the opening 22 has ends 22*a* on either side of the body hinge portion 30*a* (see FIGS. 3 and 7).

Figure 8:
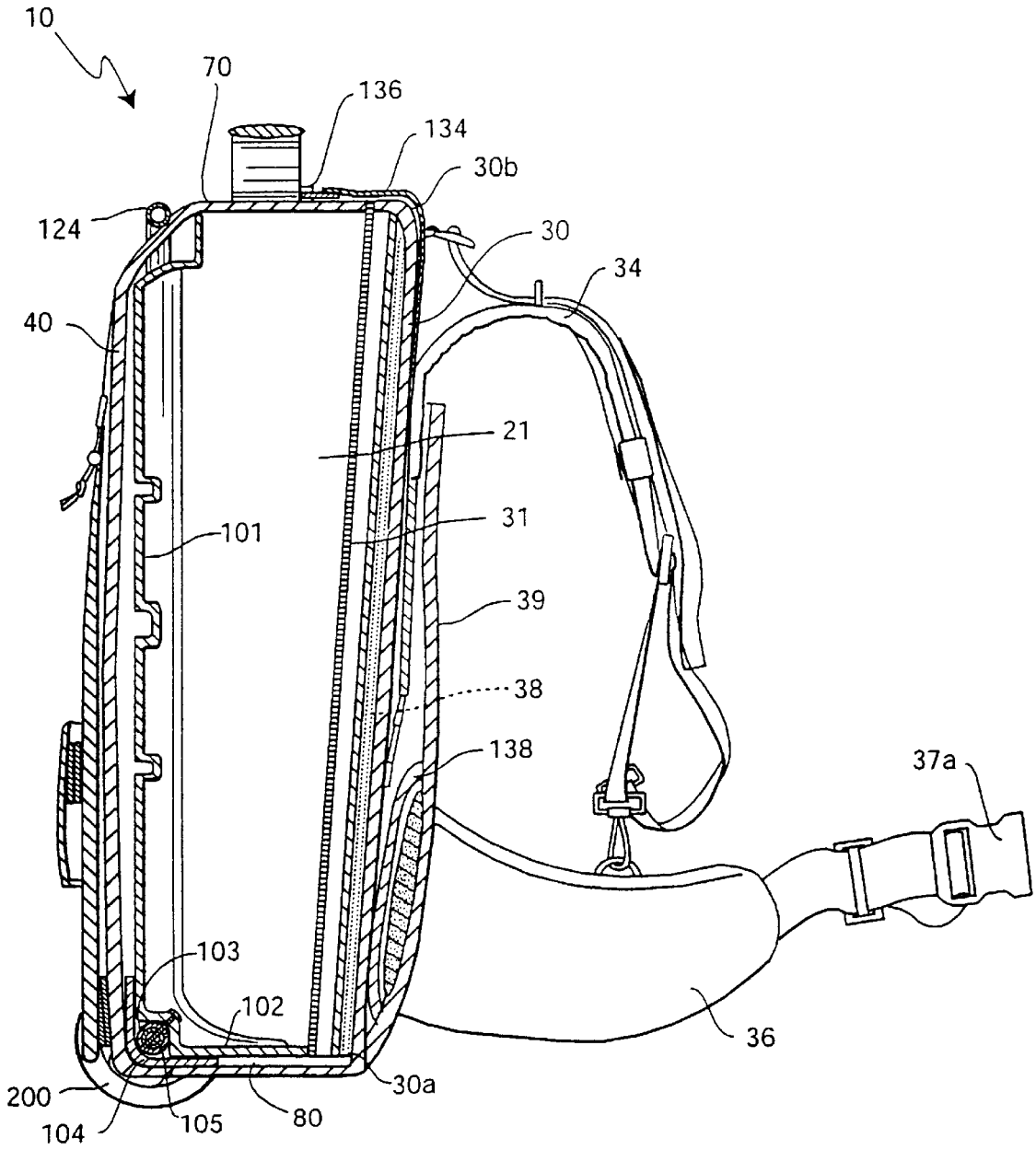
FIG. 8 is a sectional view of the backpack of FIG. 5, taken along plane 8—8 as indicated in FIGS. 5 and 6.

A zipper 31 secures the opening 22 (see FIG. 8). The zipper 31 preferably is a coil zipper such as the type manufactured by YKK of Japan, but other zippers and fastening systems could be employed. The zipper 31 has a portion or complementary half 31*a* that is attached to the body-contacting side 30 and a portion or complementary half 31*b* that is attached to the side panels 50 and 60 and to the top 70 (see FIG. 1). The zipper portions 31*a* and 31*b* detach from each other and attach to each other through the action of two sliders 31*c* (shown in FIG. 4) in order to open and close the opening 22.

Figure 7:
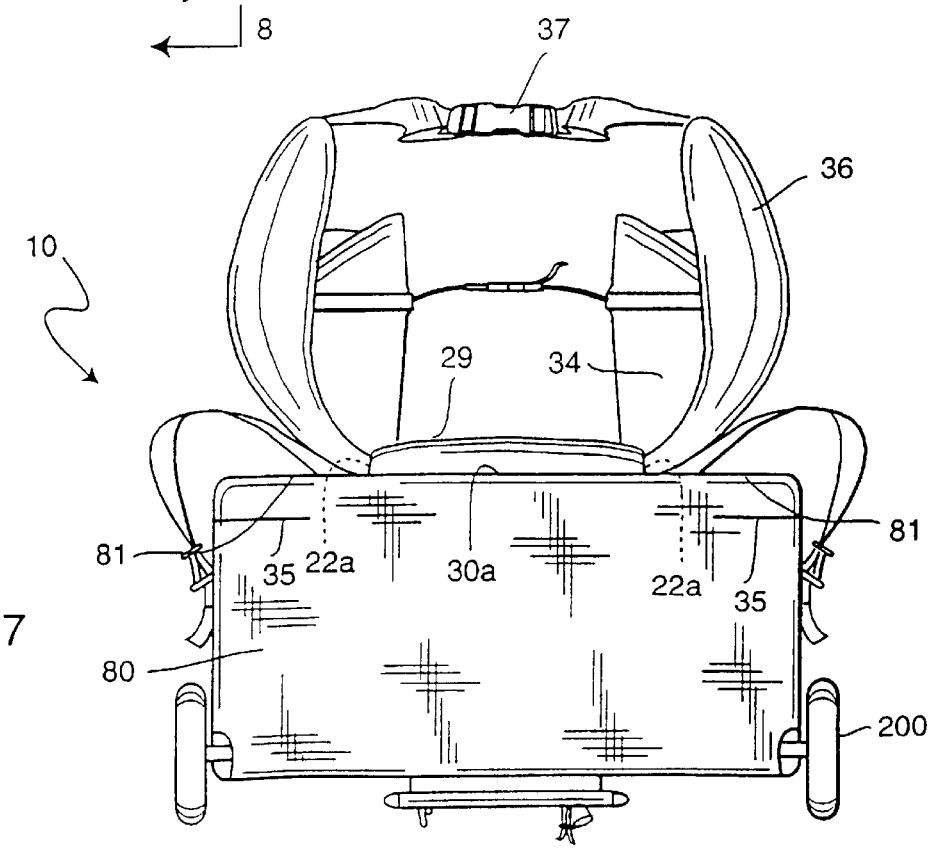
FIG. 7 is a bottom side view of the backpack of FIG. 1.

The two ends of each of the zipper portions 31*a* and 31*b* are located at the ends 22*a* of the opening 22, at the juncture of the body contact side 30 and the bottom 80 and on either side of the body hinge portion 30*a* (see FIGS. 3 and 7). As a result, the ends of the zipper portions 31*a* and 31*b* lie along a line that substantially coincides with the juncture between the bottom 80 and the body-contacting side 30. This positioning of the ends of the zipper 31 will result in less torque stress on the zipper 31 because the body-contact side 30, which is substantially rigid due to the presence of the staves 38, will hinge about the line defined by the end portions of the zipper 31 on either side of the body hinge portion 30*a*.

Figure 4:
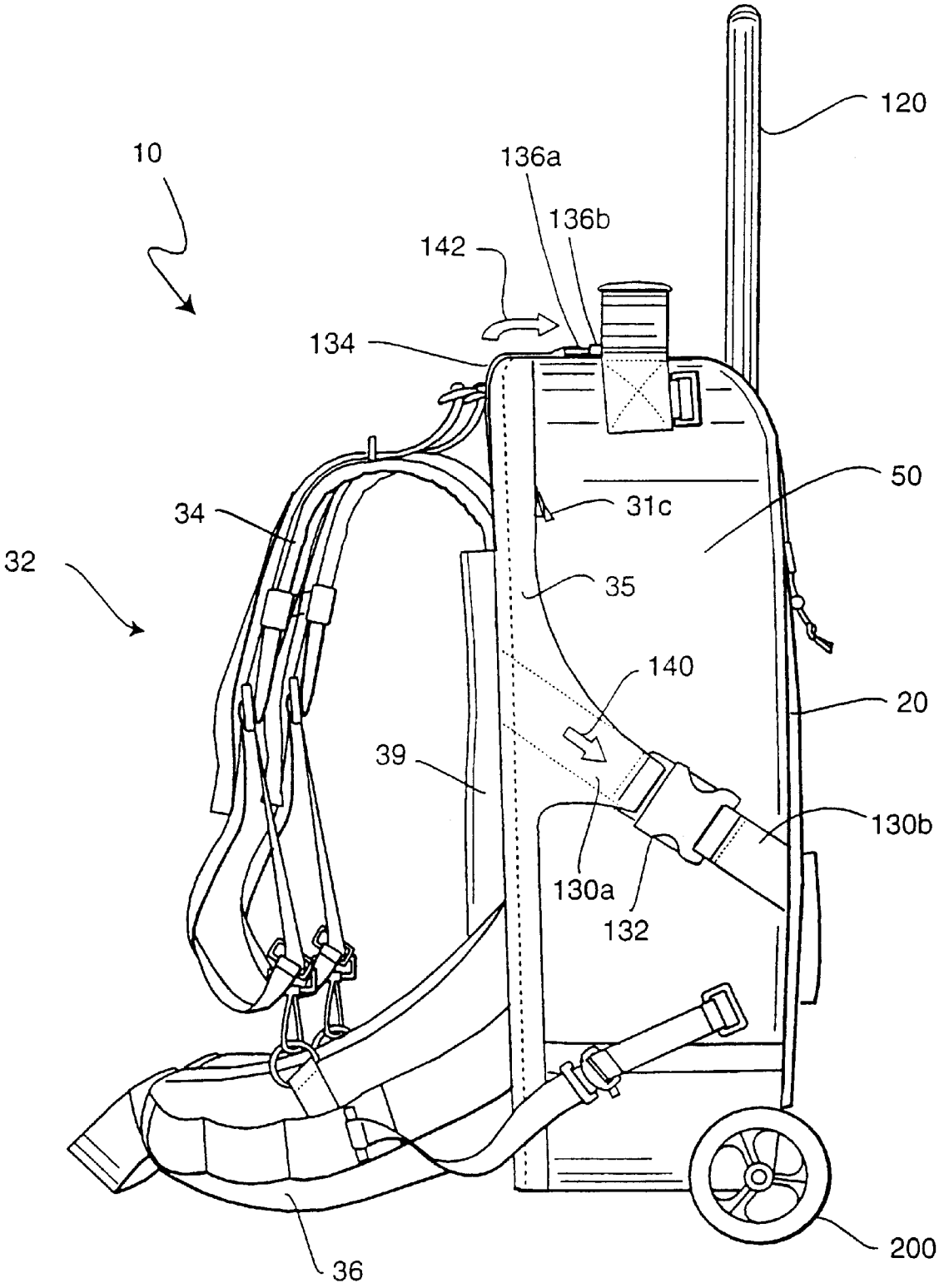
FIG. 4 is a left elevational view of the backpack of FIG. 1, showing the handle extended.
Figure 5:
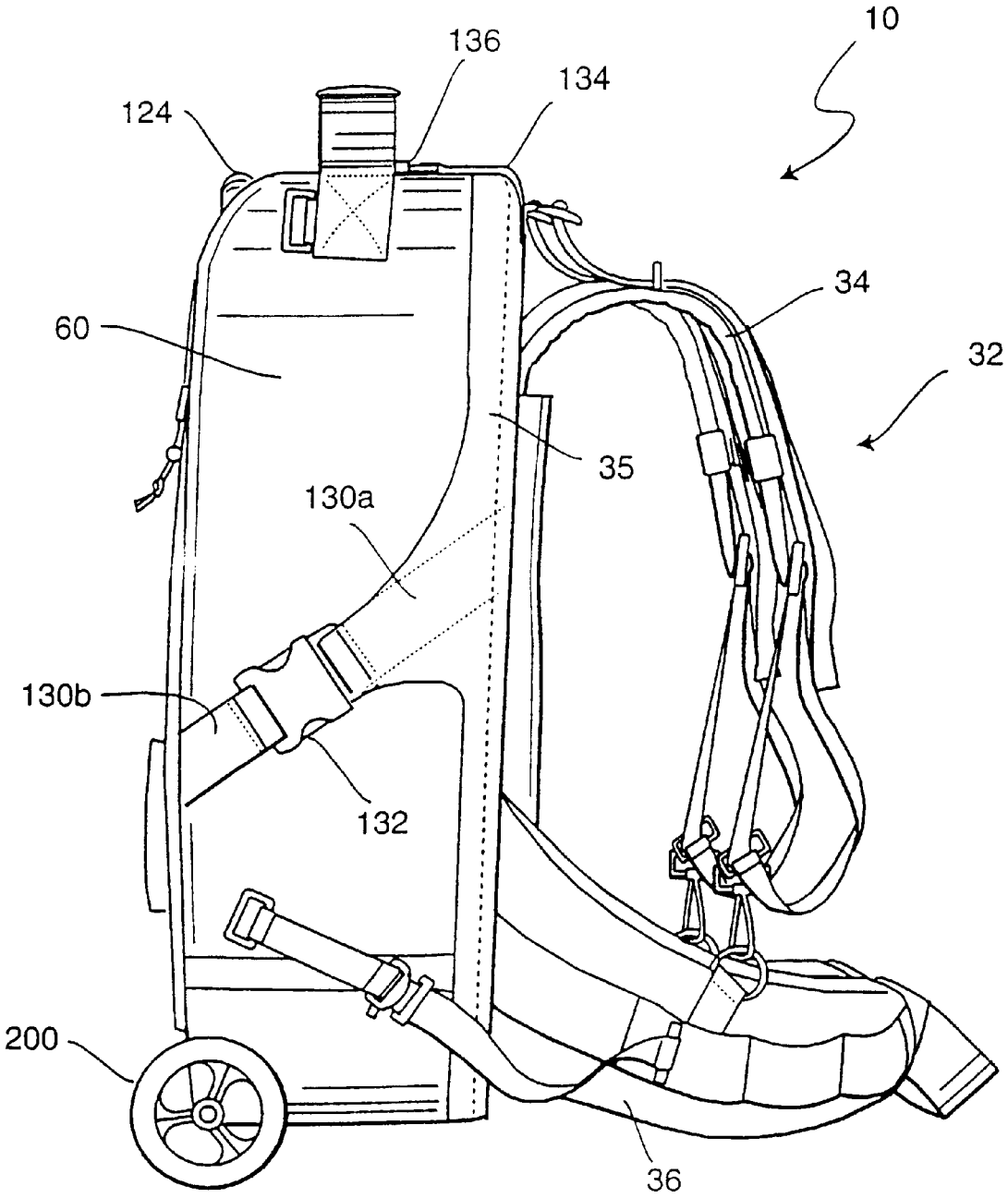
FIG. 5 is a right elevational view of the backpack of FIG. 1, showing the handle in a retracted position.
Figure 6:
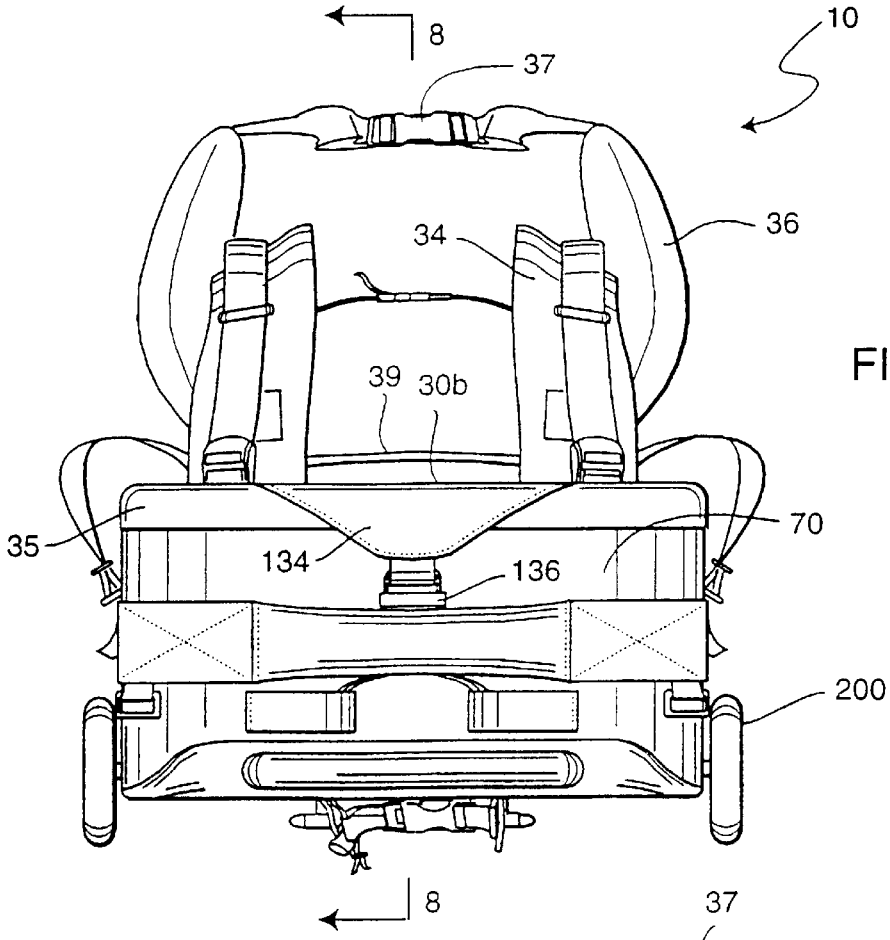
FIG. 6 is a plan view of the backpack of FIG. 1.

The body-contacting side supports the harness 32 (see, e.g., FIGS. 4 and 5). The harness 32 comprises two shoulder straps 34 and a hip belt 36. Two staves 38 are incorporated into the body-contacting side 30 (shown in hidden line in FIG. 3 and in section in FIG. 8) in order to vertically stiffen the body-contacting side 30. This will permit the user to better select how much weight will be carried by his or her shoulders as compared to the hips and will make the backpack 10 more comfortable to carry on the user's back. The staves 38 may be of conventional design, such as in the currently available Lowe Alpine Systems Contour IV backpack, in which the staves are placed in sleeves within the body-contacting side. The staves preferably are made of flat strips of aluminum alloy as in conventional backpacks but other materials, such as thermoplastics or carbon fiber composites. A frame sheet may be employed instead of the staves 38 in order to provide the stiffening to body-contact side 30.

The staves 38 are preferably aligned in a slight "V" shape and diverge from one another in going from the bottom to the top of the body-contacting side 30 (see FIG. 3), so that the lower ends of the staves are closer to each other than the top ends. This will permit the staves 38 to support the shoulder straps 34 at about the width of the user's shoulders but fit between the ends of the zipper 39 on either side of the body hinge portion 30*a*.

The user of the backpack 10 may carry the backpack 10 on his or her back by placing his or her arms through the shoulder straps 34 and adjusting the length of the shoulder straps 34 as comfort requires. The user encircles his or her hip with the hip belt 36, attaches the two components 37*a* and 37*b* of the hip belt buckle 37 (preferably a side-release buckle), and adjusts the length of the hip belt 36 as needed. The user will seek a proper balance between the amount of weight supported by his or her hips and shoulders.

The construction and use of the shoulder straps 34, the hip belt 36, and the hip belt buckle 37 are conventional and those of skill in the art will understand how to make and use these components.

The harness 32 will support the weight of the backpack 10 and any load contained in its inner compartment 21 when the user wears the backpack 10 on his or her back. The harness 32 is generally attached to the body-contacting side 30. The body-contacting side 30 is secured by the zipper 31 at its top edge 30*b* and side edges 30*c* and 30*d* to the top 70 and the side panels 50 and 60, respectively. The zipper 31 therefore would bear the greater part of the weight of the backpack 10 and its load and this would lead to failure of the zipper 31 in time because a sideways tension will tend to separate the zipper components 31*a* and 31*b* when these zipper components are joined by running the sliders 31*c* along them. Accordingly, a separate load support transfer system is provided for transferring a substantial part of the weight of the backpack 10 and its contents to the body-contact side 30 and the harness 32 when the user wears the backpack 10 on his or her back.

The purpose of the load support transfer system is to reduce the tension on the zipper 31 and thus to prevent its early failure. Preferably, the load support transfer system will be capable of supporting the weight of the backpack 10 and its contents even when the zipper 31 is open, the zipper components 31*a* and 31*b* are separated from each other, and nothing is closing the opening 22.

The load support transfer system has two side straps 130, one on each side of the backpack 10 (see FIGS. 1, 4, and 5). Each side strap 130 has two portions 130*a* and 130*b* joined by a side-release buckle 132. The side strap portions 130*a* are attached to the weather flap 35 that is attached to the body-contact side 30 and covers the zipper 31 when it is closed. The side strap portions 130*b* are attached to other parts of the backpack 10 so that, when joined by the side-release buckle 132, the two portions 130*a* and 130*b* will connect the body-contact side 30 to the remainder of the backpack 10 so as to transmit a substantial portion of the weight of the backpack 10 and its contents to the body-contact side 30 and thus to the harness 32 when the user wears the backpack 10 on his or her back.

The side-release buckle 132 has cooperating male and female components 132*a* and 132*b* that can be readily separated by exerting finger pressure on tabs when the user desires to unzip the zipper 31 and fold back the body-contact side 30, hinging it about the bottom hinge portion 30*a*, in order to access the contents of the inner compartment 21 through the opening 22.

Preferably, the side strap portions 130*b* will be attached to the side panels 50 and 60 at their junctures or seams with the non body-contact side 40, and at a position lower in height than the attachment point of the portions 130*a* so that a substantial part of the weight of the backpack 10 and it contents will be transferred upwardly to the body-contact side 30 as shown by the imaginary and illustrative side force arrow 140 in FIG. 4.

Another part of the load support transfer system is a triangular-shaped top flap 134 that is attached at its base to the body-contact side 30 (see FIGS. 1, 4, 5, and 6). A side-release buckle 136 connects the top flap 134 to the top 70. The top flap 134 folds over the weather flap 35 when the zipper 31 is closed and the male and female portions 136*a* and 136*b* of the side-release buckle 136 are attached to each other. The top flap 134 and the side-release buckle 136 will transmit a substantial portion of the weight of the backpack 10 and its contents to the body-contact side 30 and thus to the harness 32, as indicated by imaginary and illustrative top force arrow 142 in FIG. 4.

The side straps 130/buckles 132 and the top flap 134/buckle 136 combinations comprise the load support transfer system 130 and, together or separately, will support the load of the backpack 10 and its contents even when the zipper 31 is completely unzipped and open and the backpack is mounted on the user's back. When the side straps 130/buckles 132 and the top flap 134/buckle 136 are secured over the opening 22, the body-contact side 30 preferably will be drawn closer to the remainder of the body portion 20 so that the zipper 31 will not be under any tension at all. The zipper 31 then will be capable of being opened and closed when the backpack is worn on the back of the user even if a heavy load is carried in the compartment 21.

In order to further ensure that as little tension as possible is placed on the zipper 31, the hip belt 36 is not attached to the body-contact side 30 except at the bottom hinge portion 30*a*. As is best shown in FIG. 8, the body-contact side 30 is partially covered by a padded back pad 39 that is secured to the juncture of the bottom 80 and the bottom hinge portion 30*a* of the body-contact side 30. A sleeve 138 is sewn to the inside of the back pad 39. The hip belt 36 passes between the back pad 39 and the sleeve 136. The weight supported by the hip belt 36 will be transmitted by the back pad 39 and the sleeve 138 to the juncture of the bottom 80 with the bottom hinge portion 30*a*. The hip belt 36 therefore will not substantially contribute to any load on the zipper 31.

The non body-contacting or front side 40 is the side of the bag portion 20 opposite the body-contacting side 30 and is generally parallel to that side. It contains or incorporates the vertical or top portion 101 of the frame assembly 100 (the bottom 80 contains or incorporates the horizontal or bottom portion 102 of the frame assembly 100). The position of the frame assembly 100 in the bag portion 20 is best seen in FIG. 8 and a preferred form of the frame assembly 100 is shown separately in FIGS. 9, 10, and 10A. The apertures 42 in the non body-contacting side 40 permit the handle assembly 120 to slide through the apertures 42 up to a deployed position as shown in FIGS. 1–4 and down to a retracted position as shown in FIGS. 5 and 8.

The frame assembly 100 shown in FIGS. 8–10A preferably is molded from a single sheet of ABS thermoplastic with stiffening ribs and declivities. The vertical or top portion 101 and the horizontal or bottom portion 102 are parts of the same sheet and are joined at an integrally formed groove in which is placed the axle tube 103. An angle piece 104 is glued to the vertical portion 101 and the horizontal portion 102 over the axle tube 103. The securing screws 105 further secure the axle tube 103 and prevent its rotation with respect to the frame assembly 100. The axle tube 103 preferably is made of an aluminum alloy.

The handle system 120 is comprised of two vertical tubes or members 122 connected to a U-shaped handle tube 124. The tubes 122 and 124 preferably are made of an aluminum alloy. The user will grasp the handle tube 124 with his or her hand when it is in the extended position shown in FIGS. 1–4 (see especially FIG. 1) in order to push or pull the backpack 10 when the wheel assemblies 200 support the backpack 10 in the rolling mode of transport.

The handle tube 124 is slidingly joined to the vertical tubes 122 so that it will telescope back and forth with respect to the vertical tubes 122. A spring-loaded pin 125 in each of the upright portions of the handle tube 124 will engage with a corresponding aperture 126 in a vertical tube 122 in order to lock the handle system in the extended position shown in FIGS. 1–4 and 10. Pressing on the spring-loaded pins 125 will depress these pins 125 in order to disengage them from the apertures 126 in the vertical tubes 122. This will permit the handle tube 124 to slide down with respect to the vertical tubes 122.

The handle tube 124 may have a sleeve of foam or other soft material or attached grip (not shown) for the comfort of the user, as is known to the art of rolling soft luggage.

Figure 9:
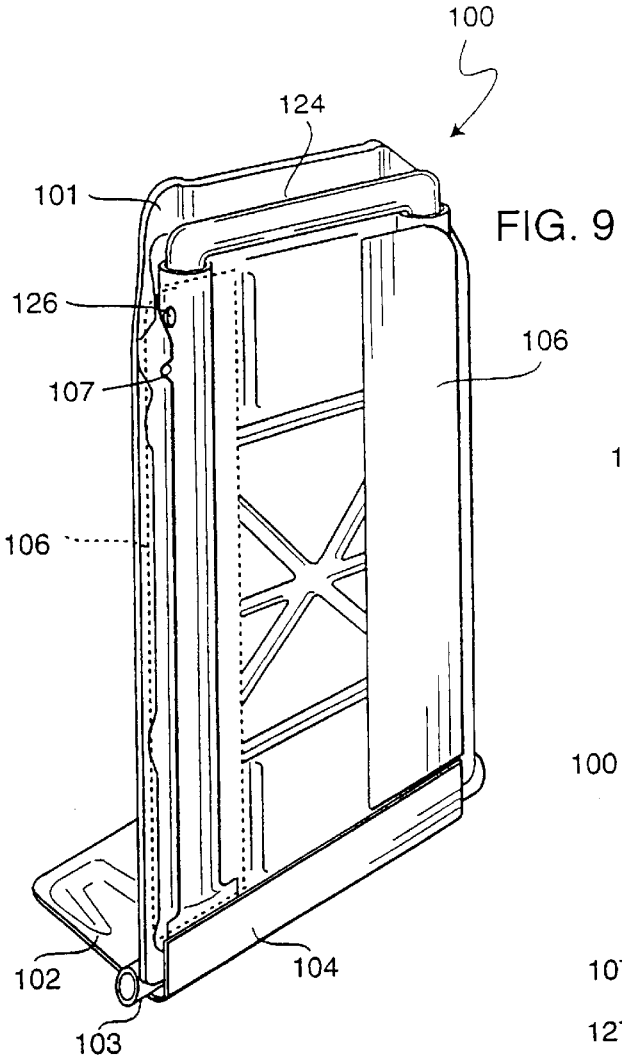
FIG. 9 is a rear perspective view from above of a preferred embodiment of a frame and handle system for use in a backpack according to the invention, showing the handle in the retracted position.
Figure 10A:
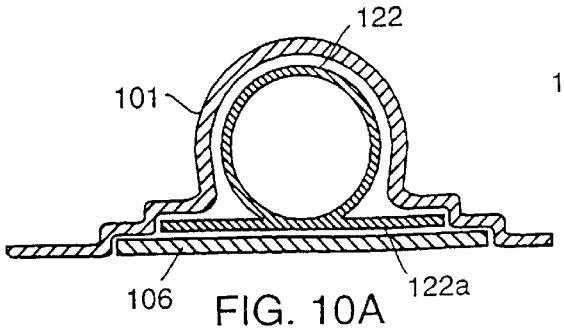
FIG. 10A is a partial sectional view of the frame and handle system of FIG. 10.
Figure 10:
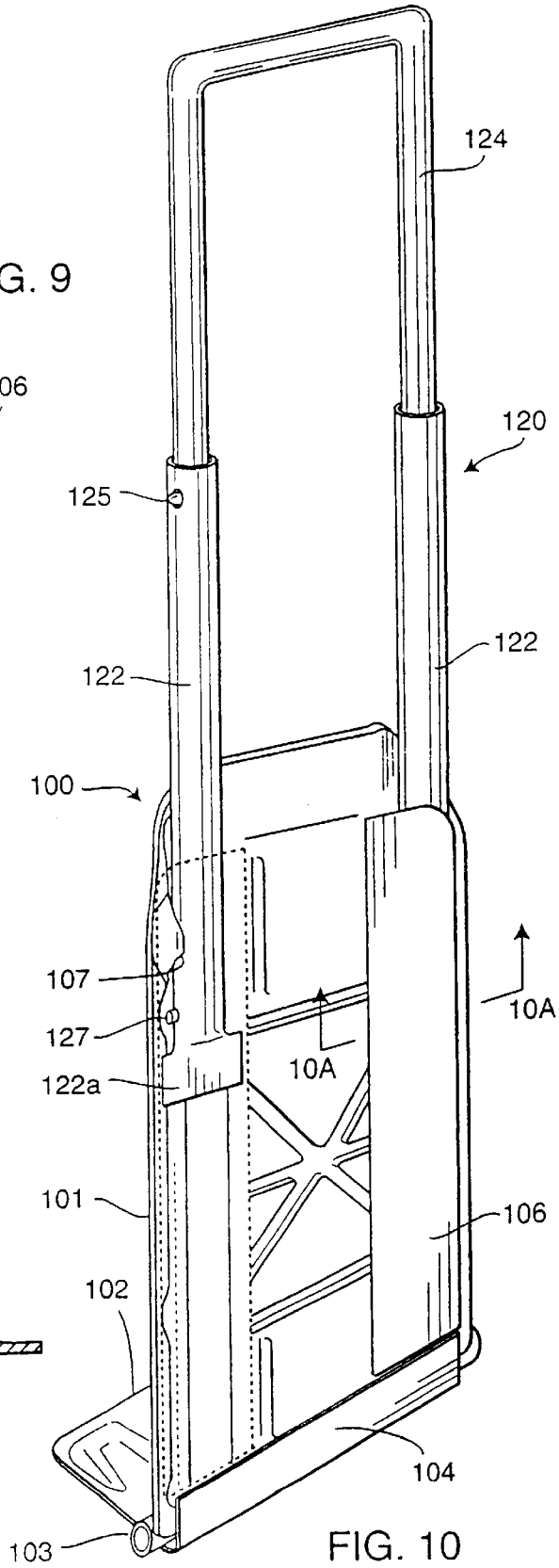
FIG. 10 is a rear perspective view from above of the frame and handle system of FIG. 9, showing the handle in the extended position.

The vertical tubes 122 themselves will slide up and down in grooves in the vertical portion 101 of the frame system 100 (see FIGS. 9 and 10). The handle system securing panels 106 are glued to the vertical portion 101 over the vertical tubes 122 in order to retain those tubes 122 in their grooves in the vertical portion 101. The vertical tubes 122 have flat extensions 122*a* welded or otherwise formed at their bases that cooperate with the vertical portion 101 to prevent rotation of the vertical tubes 122. Proper orientation of the vertical tubes 122 is necessary to ensure the continued functioning of the spring-loaded pins 125 and 127 by permitting these pins 125 and 127 to engage the apertures 126 and the detents 107.

The spring-loaded pins 127 are located in the vertical tubes 122 and engage the detents 107 molded in the vertical portion 101 when the handle system 120 is in its extended position. The detents 106 have sloped edges so that a firm thrust down on the handle tube 124 will cause the spring-loaded pins 127 to retract so that the vertical tubes 122 will slide down into the contracted position shown in FIG. 9. The action of the spring-loaded pins 125 and 127 in conjunction with the apertures 126 and the detents 107 secures the handle system 120 in the extended position so that it will not collapse unexpectedly when the user is pushing or pulling the handle system 120.

Holes in the bag portion 20 will permit the ends of the axle tube 103 to be exposed to mating with the wheel assemblies 200 (see FIG. 7).

Figure 11:
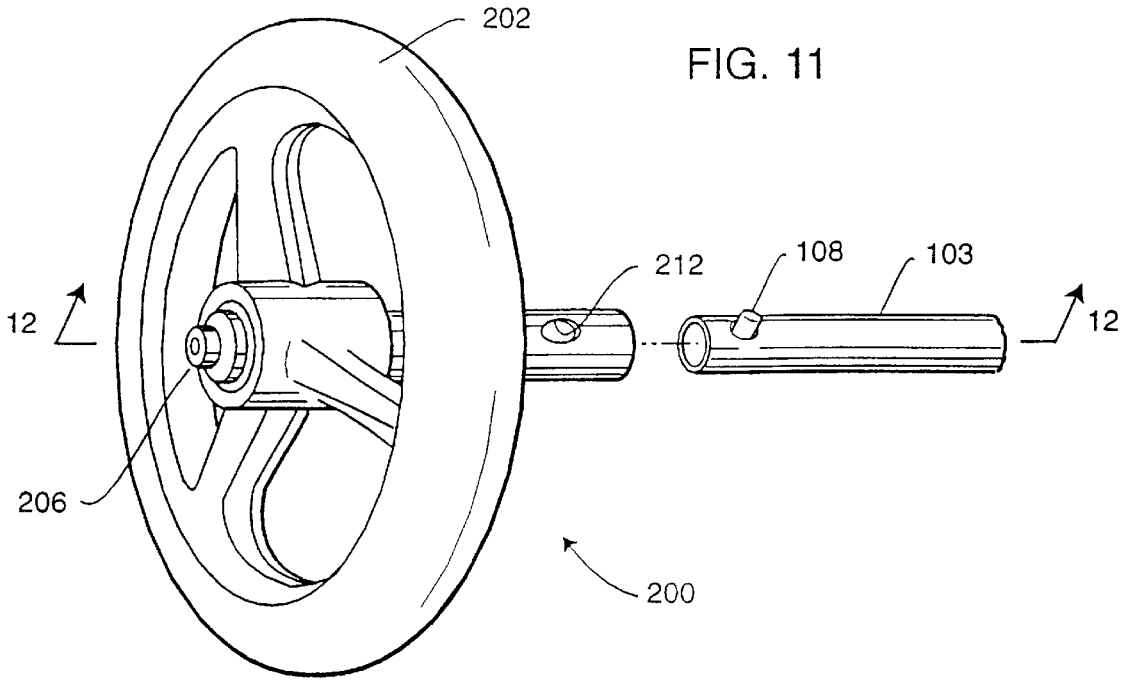
FIG. 11 is an exploded side perspective view of a preferred embodiment of a removable wheel assembly for use in a backpack according to the invention and a portion of a frame assembly to which it is attached.
Figure 12:
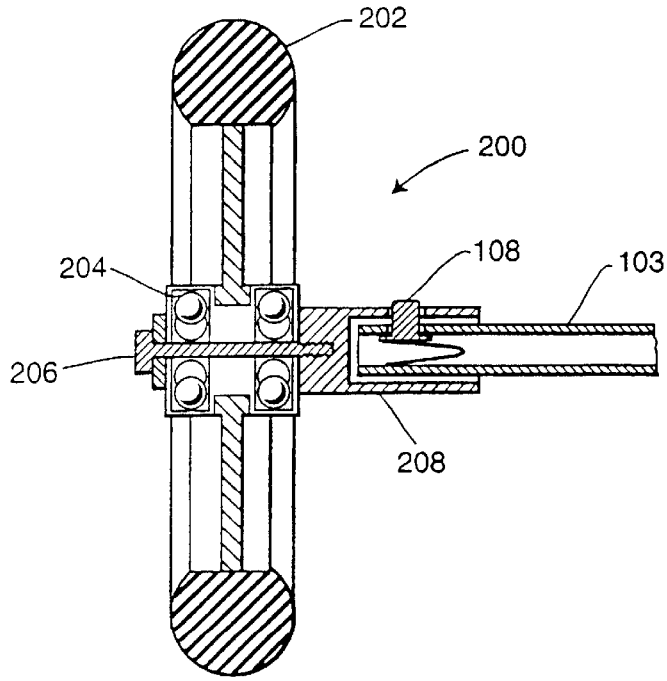
FIG. 12 is a sectional view of the wheel assembly and the frame assembly portion of FIG. 11 shown joined together as they would be when the wheel assembly is attached to the frame assembly.

FIGS. 11–12 show details of the preferred embodiment 200 of a wheel assembly shown attached to the backpack 10 in FIGS. 1–8. FIGS. 13–15 show a second preferred embodiment 201 of a wheel assembly that permits rotation of the wheel assemblies 201 to a retracted position when the wheel assemblies 201 are mounted on the backpack 10.

The wheel assemblies 200 and 201 each have a molded thermoplastic wheel portion 202. A bearing unit 204 placed at the center of the wheel portion 202 permits relatively frictionless revolution of the wheel assembly 200 or 201 (see FIGS. 12 and 14). A bolt 206 joins the bearing unit 204 to an axle sleeve 208 (wheel assembly 200, see FIG. 12) or an axle leg 210 (wheel assembly 201, see FIG. 14). The wheel portion 202 can revolve with respect to axle sleeve 208 or axle leg 210.

Both the axle sleeve 208 and the axle leg 210 have cylindrical chambers for receiving one of the ends of the axle tube 103. The axle tube 103 has a spring-loaded pin 108 at each end that extends perpendicular to the axis of the axle tube 103 (see FIGS. 11–14) that penetrates into an aperture 212 in the axle sleeve 208 (see FIGS. 11–12) or the axle leg 210 (see FIGS. 13–14) in order to secure and retain the wheel assembly 200 or 201 in place on the end of the axle tube 103. Pressing on the spring-loaded pins 108 will permit the release of the wheel assemblies 200 or 201 from the axle tube 103. The wheel assemblies can then be stored inside the inner compartment 20 or in another place.

The detachable wheel assemblies 200 or 201 will have a wider wheelbase than the fixed wheel systems found in conventional wheeled backpacks and thus greater stability in the rolling mode. A small wheelbase leads to unwanted rotation or oscillation of a wheeled pack about its vertical axis when the user tows it by its handle. A wider wheelbase avoids this problem. Furthermore, detachable wheel assemblies can have larger radii and thus provide greater ground clearance, which will greatly enhance the cross-country mobility of the backpack 10. In addition, the user can remove the wheel assemblies in order to reduce the size profile of the backpack 10 for transport, as in an airliner, and to reduce the danger of damage to the wheel assemblies when being transported by public transportation.

The embodiment 201 of the wheel assembly has an axle leg 210 that has two apertures 212 for receiving the spring-loaded pin 108 in the ends of the axle tube 103. The two apertures 212 are positioned at about 90 degrees with respect to each other in relation to the axis of the axle tube 103 when the wheel assembly 201 is mounted on the axle tube 103. This will permit the wheel assembly 201 to be rotated between an effective or rolling position protruding from the non body-contact side 40 of the backpack 10 (see FIG. 15, solid line) and a contracted position against one of the side panels 50 or 60 (see FIG. 15, dashed line). This permits relatively large wheel assemblies to be stored in a safer and out-of-the-way position without having to remove such assemblies from the backpack 10.

The detachable wheel assemblies 200 and 201, in conjunction with a frame assembly 100, may be employed with soft luggage or packs other than packs having a harness. For example, they could be used with duffle bags lacking shoulder straps.

The frame assembly 120 and the associated wheel assemblies 120 and 121 shown in the drawings are currently preferred for cross-country travel. Other frame assemblies and wheel assemblies might be employed. For use on paved or otherwise flat man-made surfaces, fixed (and smaller) wheels attached to a frame may be acceptable and will have the further advantage that they cannot be lost by the user without losing the entire backpack. Those of skill in the art will recognize that unitary or combination frame and fixed wheel assemblies are well known and could be employed for such a purpose. The frame assembly itself could have a conventional format in which the frame assembly has two vertical ribs and a handle system with a catch built into the handle for permitting contraction of the handle.

An example of known systems of this type are the CK420CL handle system and the CKW089 plastic fixed wheel housing (with wheels) system available from Chaw Kong of Taipei, Taiwan. The CK420CL handle system and the CKW089 plastic wheel housing system may be used together in a backpack according to this invention at the expense of reduced cross-country mobility (because of smaller diameter wheels), a shorter wheelbase, and loss of the convenience of removable wheel assemblies.

A stiff or rigid stand 44 is hinged to the non body-contacting side 40 (see FIG. 1). The stand 44 may be deployed into an extended position as shown in dashed line in FIG. 1 in order to support the backpack 10 on the surface of the ground in a generally inclined position, resting on the two wheel assemblies 200 and the ground-contacting end 45 of the stand 44 when the user is not holding the handle assembly 120.

Readers of skill in the art to which this invention pertains will understand that the foregoing description of the details of preferred embodiments is not to be construed in any manner as to limit the invention. Such readers will understand that other embodiments may be made which fall within the scope of the invention, which is defined by the following claims and their legal equivalents.

We claim:

1. A backpack, comprising:

a bag portion having a body-contact side, a non-body contact side, two side panels, a top, and a base, the body-contact side and the non body-contact side facing each other and being joined to the base, the side panels, and the top so as to define a compartment;

a pair of shoulder straps provided on the body-contact side of the bag portion and adapted to be hung from the user's shoulders;

an opening defined in the bag portion adjacent and parallel to the body-contact side for providing entry to the compartment from the exterior of the backpack;

a zipper having complementary halves attached on either side of the opening, the halves of the zipper having at least one slider for reversibly separating the halves of the zipper for permitting access to the compartment and reversibly attaching the halves of the zipper for securing the opening from entry from the exterior of the backpack;

a load support transfer system comprising at least one strap joining the body-contact side to one of the side panels and the non body-contact side across the opening whereby a substantial part of the weight of the backpack is transferred to the body-contact side when the backpack is mounted on the user's back and thereby reducing the tension on the zipper when the opening in the bag portion is closed;

a frame assembly extending along and attached to the non body-contact side, the frame assembly comprising a bottom portion and a top portion;

at least one wheel assembly attached to the bottom portion of the frame assembly, at least a portion of the wheel assembly extending out from the bag portion whereby the wheel assembly can support a substantial part of the weight of the backpack when the bag portion is substantially above the wheel assembly and the wheel assembly is in contact with a surface; and a handle attached to a first end of at least one member made of a rigid material and mounted to the frame assembly so that the member can slide between an extended position above the top portion of the frame assembly in which the user can grasp the handle and pull or push the bag portion of the backpack across a surface when the weight of the bag portion is substantially resting on the at least one wheel assembly and a retracted position in which the handle is adjacent the top portion of the frame assembly.

2. The backpack according to claim 1 in which two wheel assemblies are attached to the bottom portion of the frame assembly.

3. The backpack according to claim 2 in which the bottom portion is between the two wheel assemblies.

4. The backpack according to claim 3 in which the wheel assemblies are detachable from the bottom portion of the frame assembly.

5. The backpack according to claim 1 comprising two members, the members being spaced apart from each other in a plane parallel to a plane defined by the non body-contact side, the two members being parallel to each other, and the handle being attached to and between the first ends of the members.

6. The backpack according to claim 1 further comprising a strap joining the body-contact side to the top.

7. A backpack, comprising:

a bag portion having a body-contact side, a non-body contact side, two side panels, a top, and a base, the body-contact side and the non body-contact side facing each other and being joined to the base, the side panels, and the top so as to define a compartment;

a pair of shoulder straps provided on the body-contact side of the bag portion and adapted to be hung from the user's shoulders;

an opening defined in the bag portion adjacent and parallel to the body-contact side for providing entry to the compartment from the exterior of the backpack;

a zipper having complementary halves attached on either side of the opening, the halves of the zipper having at least one slider for reversibly separating the halves of the zipper for permitting access to the compartment and reversibly attaching the halves of the zipper for securing the opening from entry from the exterior of the backpack; and at least one side strap joining the body-contact side to one of the side panels and the non body-contact side across the opening adjacent to the one of the side panels whereby a substantial part of the weight of the backpack is transferred to the body-contact side when the backpack is mounted on the user's back and thereby reducing the tension on the zipper when the opening in the bag portion is closed.

8. The backpack according to claim 7 comprising at least two side straps joining the body-contact side to one of the side panels and the non body-contact side across the opening, one side strap crossing the opening adjacent to each of the side panels, whereby a substantial part of the weight of the backpack is transferred via the side straps to the body-contact side when the backpack is mounted on the user's back and thereby reducing the tension on the zipper when the opening to the compartment is closed.

9. The backpack according to claim 7 in which each side strap is angled from the body-contact side in the direction of the bottom.

10. The backpack according to claims 7 in which the opening is defined in the top and the side panels adjacent to the body contact side.

11. The backpack according to claim 10 in which the zipper has two ends each adjacent to the bottom.

12. The backpack according to claim 7 further comprising a weather flap attached to the body-contact side and adapted to cover and protect the zipper when the opening is closed.

13. The backpack according to claim 12 in which each of the side straps is secured to the weather flap.

14. The backpack according to claim 7 further comprising means for releasing each side strap to permit the body-contact side to be rotated in order to permit access from the exterior to the compartment when the zipper is not closed.

15. The backpack according to claim 10 further comprising a top strap disposed across the opening adjacent to the top, the top strap comprising a first end attached to the body contact side, a second end attached to the top side, and intermediate releasable fastening means whereby the top strap can be connected across and above the opening adjacent to the top in order to reduce the tension on the zipper when the opening is closed and the backpack is mounted on the user's back.

16. The backpack according to claim 15 in which the first end of the top strap is broadened at its attachment to the body-contact side thereby to reduce the tension on the attachment to the body-contact side.

17. The backpack according to claim 10 further comprising a belt adapted to be secured around the hip of the user, the belt being attached to the base so that the weight of the backpack is not transferred to the belt through the body-contact side in order to reduce the tension on the zipper when the opening to the compartment is closed.

18. The backpack according to claim 11 in which the opening curves inward towards the bottom section so that the ends of the zipper are substantially in line and the zipper thereby is not twisted when the body-contact side is rotated away from the top section and the side panels in order to expose the compartment to access from the exterior.

19. A backpack, comprising:

a bag portion having a body-contact side, a non-body contact side, two side panels, a top, and a base, the body-contact side and the non body-contact side facing each other and being joined to the base, the side panels, and the top so as to define a compartment;

a pair of shoulder straps provided on the body-contact side of the bag portion and adapted to be hung from the user's shoulders;

an opening defined in the bag portion adjacent and parallel to the body-contact side;

a zipper having complementary halves attached on either side of the opening, the halves of the zipper having at least one slider for reversibly separating the halves of the zipper for permitting access to the compartment and reversibly attaching the halves of the zipper for securing the opening from entry from the exterior of the backpack;

a weather flap attached to the body-contact side and adapted to cover and protect the zipper when the opening is closed; and at least one side strap secured to the weather flap and to one of the side panels and the non body-contact side whereby a substantial part of the weight of the backpack is transferred to the body-contact side when the backpack is mounted on the user's back and thereby reducing the tension on the zipper when the opening in the bag portion is closed.

* * * * *